US006113257A

United States Patent [19]

Sharon et al.

[11] Patent Number: 6,113,257

[45] Date of Patent: Sep. 5, 2000

[54] TWO-COMPARTMENT CONTAINER

[75] Inventors: Igal Sharon, Caesaria; Michael Inbar, Neot Achva, both of Israel

[73] Assignee: M.L.I.S. Projects Ltd., Herzkuta, Israel

[21] Appl. No.: 08/839,136

[22] Filed: Apr. 23, 1997

Related U.S. Application Data

[63] Continuation-in-part of application No. 08/811,007, Mar. 4, 1997, which is a continuation-in-part of application No. 08/773,154, Dec. 26, 1996.

[51] Int. Cl.[7] ..... B01F 11/00

[52] U.S. Cl. ..... 366/130; 566/348; 215/DIG. 8; 215/11.4; 206/221

[58] Field of Search ..... 366/130, 129, 366/150.1, 189, 348, 349, 342; 206/221, 219, 222; 426/117, 119; 215/11.4, DIG. 8

[56] References Cited

U.S. PATENT DOCUMENTS

| | | | |
|---|---|---|---|
| 611,520 | 9/1898 | Smith | 206/221 |
| 2,371,774 | 3/1945 | Nosik . | |
| 2,494,294 | 1/1950 | Greenberg | 206/221 |
| 2,533,806 | 12/1950 | Holzapfel . | |
| 2,689,566 | 9/1954 | Lockhart | 206/221 |
| 2,781,141 | 2/1957 | Lucien . | |
| 2,786,769 | 3/1957 | Greenspan | 206/221 |
| 2,793,776 | 5/1957 | Lipari . | |
| 2,807,384 | 9/1957 | Lipari | 215/11 |
| 2,813,649 | 11/1957 | Lipari . | |
| 2,885,104 | 5/1959 | Greenspan . | |
| 2,931,731 | 4/1960 | Pohjola | 99/171 |
| 3,220,588 | 11/1965 | Lipari | 215/11 |
| 3,240,403 | 3/1966 | Modderno . | |
| 3,305,368 | 2/1967 | Bourelle . | |
| 3,314,563 | 4/1967 | Mounier | 215/6 |
| 3,458,076 | 7/1969 | Babcock . | |
| 3,477,431 | 11/1969 | Walecka | 206/221 |
| 3,651,990 | 3/1972 | Cernel | 206/221 |
| 3,720,522 | 3/1973 | Nakagami . | |
| 3,779,372 | 12/1973 | de Lloret . | |
| 3,856,138 | 12/1974 | Maekawa et al. | 206/221 |
| 3,983,994 | 10/1976 | Wyslotsky . | |
| 4,114,784 | 9/1978 | Hough et al. . | |
| 4,221,291 | 9/1980 | Hunt . | |
| 4,387,998 | 6/1983 | Szigeti | 366/130 |
| 4,410,085 | 10/1983 | Beneziat et al. | 206/217 |
| 4,711,359 | 12/1987 | White et al. . | |
| 4,727,985 | 3/1988 | McNeirney et al. | 206/221 |
| 4,776,972 | 10/1988 | Barrett | 252/90 |
| 4,779,722 | 10/1988 | Hall | 206/221 |
| 4,823,946 | 4/1989 | Stoeffler et al. | 206/221 |
| 4,936,446 | 6/1990 | Lataix | 206/221 |
| 5,088,627 | 2/1992 | Musel | 222/145 |
| 5,275,298 | 1/1994 | Holley, Jr. et al. . | |
| 5,277,303 | 1/1994 | Goyet et al. | 206/221 |

(List continued on next page.)

FOREIGN PATENT DOCUMENTS

| | | |
|---|---|---|
| 0 357 288 A1 | 3/1990 | European Pat. Off. . |
| 0 673 847 A1 | 9/1995 | European Pat. Off. . |
| 2615729 | 12/1988 | France . |
| 43 26 152 A1 | 2/1995 | Germany . |
| 679145 | 12/1991 | Switzerland . |

*Primary Examiner*—Tony G. Soohoo
*Attorney, Agent, or Firm*—Pennie & Edmonds

[57] ABSTRACT

A container holding two separate components which are mixed prior to use is provided. The container comprises a housing with a dispensing opening and neck portion between said opening and the bottom end of housing. The container further comprises a displaceable member disposed within the housing and having a partition wall with an edge adapted for a sealing engagement with internal walls of the neck portion, thereby defining two compartments separated by said partition wall. A displaceable member is axially displaceable between two positions along an axis extending through the neck portion. These two positions comprise a first position where the edge of the partition wall sealingly engages the internal walls of the neck portion, and a second position where the edge of the partition wall and the internal walls are disengaged permitting flow communication between the two compartments. This flow communication allows mixing of the two components to form a formulation which is then ready for use.

13 Claims, 13 Drawing Sheets

U.S. PATENT DOCUMENTS 5,330,048 7/1994 Haber et al. ..... 206/221
5,348,060 9/1994 Futagawa et al. ..... 141/100
5,353,961 10/1994 Debush ..... 222/94
5,417,321 5/1995 Halm ..... 206/221
5,419,445 5/1995 Kaesemeyer ..... 215/11.1
5,429,254 7/1995 Christine ..... 215/11.1
5,433,328 7/1995 Baron et al. ..... 215/11.4
5,447,226 9/1995 Laine ..... 206/219
5,456,929 10/1995 Mifune et al. .
5,474,209 12/1995 Vallet Mas et al. ..... 222/83
5,514,394 5/1996 Lenahan .
5,529,794 6/1996 Fultz .
5,540,341 7/1996 Holley et al. ..... 215/11.4
5,542,528 8/1996 Lanfranconi et al. .
5,564,600 10/1996 Renault ..... 221/129
5,593,028 1/1997 Haber et al. ..... 206/221
5,613,623 3/1997 Hildebrandt ..... 206/221
5,634,714 6/1997 Guild ..... 366/130
5,638,968 6/1997 Baron et al. ..... 215/11.4
5,685,422 11/1997 Kim ..... 206/222

TWO-COMPARTMENT CONTAINER

CROSS REFERENCE TO RELATED APPLICATION

This patent application is a continuation-in-part of Ser. No. 08/811,007, filed Mar. 4, 1997, which is a continuation-in-part of Ser. No. 08/773,154 of Dec. 26, 1996.

FIELD OF THE INVENTION

The present invention relates to containers and particularly such comprising two compartments, each on of which holds a separate component, to be mixed with one another prior to use.

BACKGROUND OF THE INVENTION

A variety of formulations for human use are stored a priori in the form of a dry particulate matter and are mixed with a liquid to form a liquid formulation shortly before use. This is the case, for example, with various nutritive formulas, including maternal milk substitute formulas, adult feeding formulas and a variety of drugs, e.g. antibiotics. The shelf life of such mixed liquid formulations is limited, and this dictates the need to prepare it into a liquid form only shortly before use. The limited shelf life of the liquid formulation is a result of a loss of activity of an active ingredient in the formula, accelerated oxidation once in solution, etc. When preparing a liquid formula from an a priori dry particulate formula, care should be taken to mix a correct amount of the two components, i.e. the dry particulate matter and the liquid, and in various applications it is also necessary to ensure that such mixing of component is performed under aseptic conditions, e.g. in the case of a drug, formulation to be administered parenterally.

Containers having separate compartments for storing two components, e.g. one being a dry particulate substance and the other being a liquid, both of which are mixed together prior to use, are known. Such two-compartment containers typically employ a breakable or displaceable partition between the two compartments. The partition is then either broken or displaced, as the case may be, to allow mixing.

GENERAL DESCRIPTION OF THE INVENTION

It is an object of the invention to provide a novel, two-compartment container for storing two components intended to be mixed prior to use, the first of such components being typically a liquid and the other a particulate solid, e.g. powdered substance.

In accordance with the present invention, there is provided a container comprising:

a housing with a dispensing opening and a neck portion between said opening and a bottom end of the housing;

a displaceable member disposed within said housing and having a partition wall with an edge adapted for a sealing engagement with internal walls of said neck portion, thereby defining two compartments separated by said partition wall;

said displaceable member being axially displaceable between two positions along an axis extending through said neck portion, said two positions comprising a first position where the edge of said partition wall sealingly engages the internal walls of said neck portion, and a second position where said edge and said internal walls are disengaged permitting flow communication between the two compartments.

The neck portion thus divides the container in two parties, one remote from said opening defining a first compartment and another adjacent said opening defining a second compartment, the two compartments being separated from one another by said partition wall once in its first position. In accordance with a preferred embodiment, the neck portion is formed as a constricted portion of an otherwise cylindrical container.

According to one preferred embodiment of the invention, said neck portion has a circular cross-section and accordingly said partition wall is circular. The edge of said partition wall is capable of tight seal contact with the internal walls of said neck portion. This may be achieved by a resilient portion forming an integral part of said edge or by a resilient member integrated into said edge, e.g. an O-ring fitted into an annular groove formed in said edge.

The partition wall of said displaceable member is typically dependent from a manipulable portion of said member, which is user-operable to allow displacement control. The dependency of said partition wall may, by one example, be by a central projecting stem, or by a plurality of stems, typically connected to the periphery of the partition wall. By another example, the dependency may be peripheral walls having with openings. By a further example, the dependency may be by means of non-peripheral wall sections, e.g. radially oriented.

The container of the invention may be fashioned for a variety of uses. In accordance with one embodiment of the invention, said container serves as a baby's feeding bottle, in which case said first compartment contains a liquid, typically sterilized water, and said second compartment contains a powdered formula.

In accordance with another embodiment of the invention, said container is fashioned for storage of two components of a medicinal formulation, for example, said first compartment contains a liquid, e.g. a sterilized saline solution, and said second compartment contains a dry particulate drug formulation to be mixed with the liquid prior to use, e.g. an antibiotic drug formulation.

Said manipulable portion of the displaceable member may, in accordance with one embodiment of the invention, be adapted for screw engagement with the housing. In accordance with such an embodiment, the axial displacement is achieved by the relative by the relative advance as a result of the helical displacement during rotation. In accordance with another embodiment of the invention, said displaceable member is engaged with the housing such that it is axially displaceable by means of pulling or pushing on said manipulable portion.

In accordance with an embodiment of the invention, said displaceable member is provided with a safety mechanism for avoiding unintentional axial displacement. By one example, such mechanism includes at least one radially projecting lug which is engaged in a partial circumferential groove in said container, and said displaceable member is rotational between the first angular position where said at least one lug is engaged in said groove and a second angular position wherein said lug is disengaged permitting axial displacement.

In accordance with an embodiment of the invention, said displaceable member has a peripheral portion for a displaceable engagement with a top end of the housing and having an outwardly extending aperture, defining said dispensing opening.

In accordance with another embodiment of the invention, said displaceable member is engaged in a displaceable manner to the bottom end of the housing. Typically, in accordance with this embodiment, the displaceable member has a wall, defining the bottom wall of the container, which is provided with a sealable opening to allow filling of a component into said first compartment.

The opening may be fitted with a closure assembly fashioned in a manner allowing a controlled release of the formulation from the container. The closure assembly in accordance with this embodiment is fashioned in a manner depending on the intended use. For example, in the case of a container for medicinal formulation, the closure assembly may for example be a pierceable rubber stopper, adapted for inserting a syringe needle for withdrawal of the medicinal formulation; the closure assembly may also be fashioned in a manner allowing dispensing of a fixed amount of the formulation each time of a plurality of occurrences; in the case of a container intended for use as a baby's feeding bottle, the closure assembly may be a nipple. The closure assembly may also be fitted with an additional cover, e.g. aluminum foil covering a stopper or a cap covering the nipple, to secure the closure or allow the maintaining and/or sterility. In the case for a cap covering a nipple, the cap may be fitted in a manner to seal the nipple's opening so as to avoid spillage of the liquid formulation during mixing of the two components.

The container may be made for a one time use, i.e. disposable, e.g. housing made from thin plastic material. In addition, the container may be made to be recyclable, i.e. to be returned to the manufacturer after use for refilling. Furthermore, the container may also be made in a manner to allow refilling with the two components by the user.

The present invention further provides a process for preparing of a container holding two separate components of a formulation to mix with one another prior to use.

In accordance with one embodiment, the process comprises:

(a) providing a container having a housing with an opening at a top end and having a neck portion between said opening and a bottom end of the housing, separating the container into a first bottom compartment and a second compartment adjacent said opening, (b) introducing a first component of said formulation into the container through said opening;

(c) fitting a displaceable member into said housing, said displaceable member having a partition wall with an edge adapted for sealing engagement with internal walls of said neck portion, and being axially displaceable along an axis extending through said neck portion between a first position where the edge of said partition wall engages the internal walls of said neck portion, and a second position where said edge and said internal wall are disengaged to allow flow communication between the two compartments; said displaceable member being fitted into said container in said first position;

(d) introducing said second component into said second compartment; and (e) sealing said opening.

By another embodiment, the process comprises:

(a) providing a body for use as a housing of a container, having an internal space extending between two open ends and a neck portion intermediate the two ends; one of the two open ends, which the bottom end of the container, being fitted with an axially displaceable member comprising a wall portion sealably engaged at said opening in a manner allowing axial displacement and comprising a partition wall dependent from said wall portion with an edge adapted for sealing engagement with the internal walls of said neck portion; said displaceable member is fitted within said body such that said partition wall engages said neck portion defining a first, bottom compartment and a second, top compartment, said displaceable member comprising a sealable filling aperture in said wall partions;

(b) introducing a first component of said formulations into said first compartment through said filling aperture, and sealing said aperture;

(c) introducing said second component into said second compartment through the opening at the other end of said body; and (d) sealing said opening.

In accordance with one embodiment, the process is performed under septic conditions. In accordance with this embodiment, the process further comprises:

placing a cover over the seal.

The invention still further provides a method for the preparation of a liquid formulation from a priori to individual components, the method comprising:

(a) providing a container as defined above with each of the two components being stored in one of the container's two compartments;

(b) axially displacing said displaceable member into said second compartment;

(c) agitating the container to mix the two components into said formulation.

One feature of preparing a liquid formulation using the container of the invention, particularly where the container is pre-filled in a manufacturing site, is that a correct ratio between the two components, e.g. between the powder and a liquid, may be observed.

The invention will now be illustrated in some specific embodiments concerned with a baby's feeding bottle in accordance with the invention. It will be appreciated by the artisan that the same principle, mutatis mutandis, is also applicable in case of other containers of the invention, e.g. such intended for use for independent storing of two components or for a medicinal formulation which are mixed prior to use.

DETAILED DESCRIPTION OF A SPECIFIC EMBODIMENT

Figure 1:
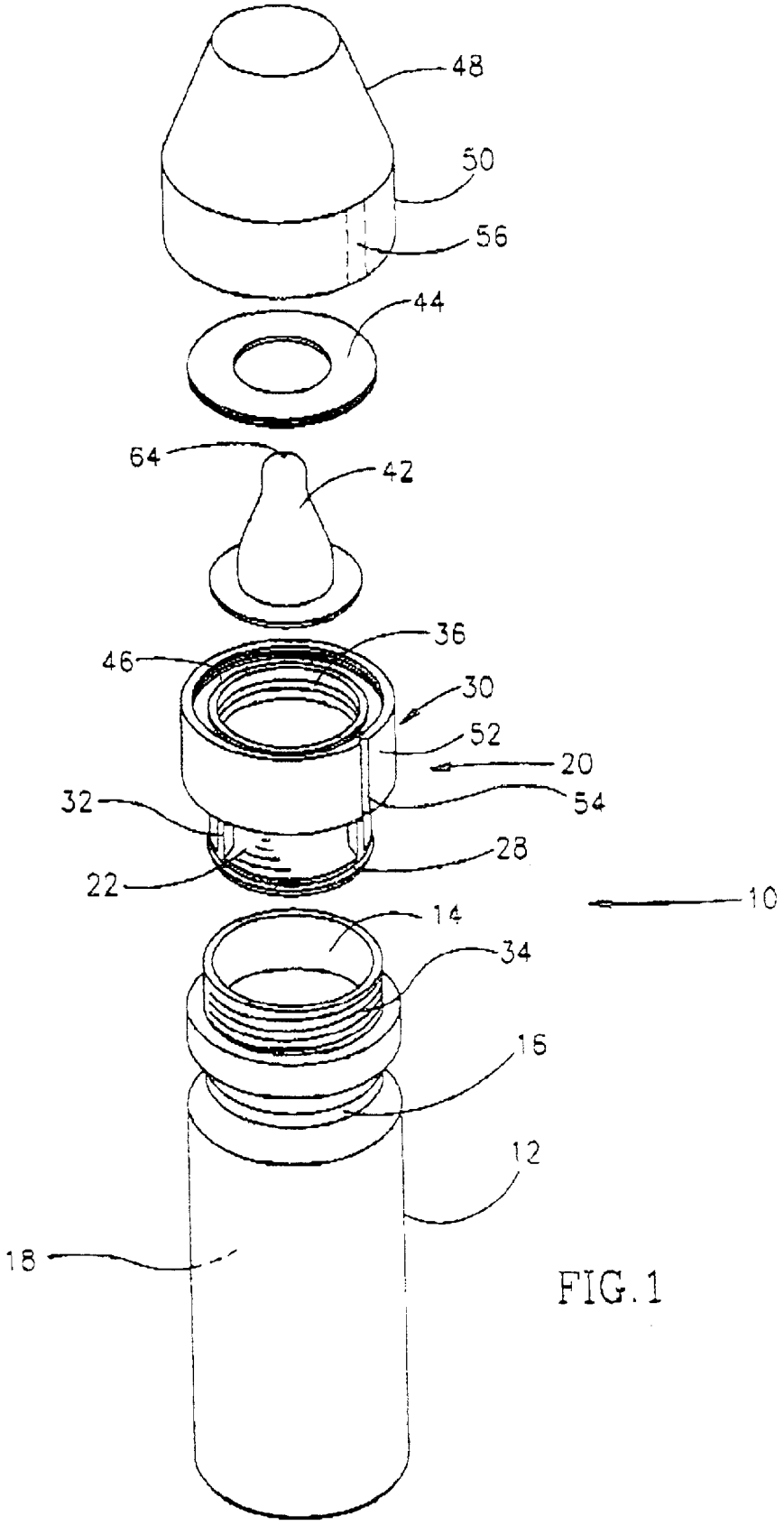
FIG. 1 is an exploded perspective view of a baby's feeding bottle in accordance with an embodiment of the invention.
Figure 2:
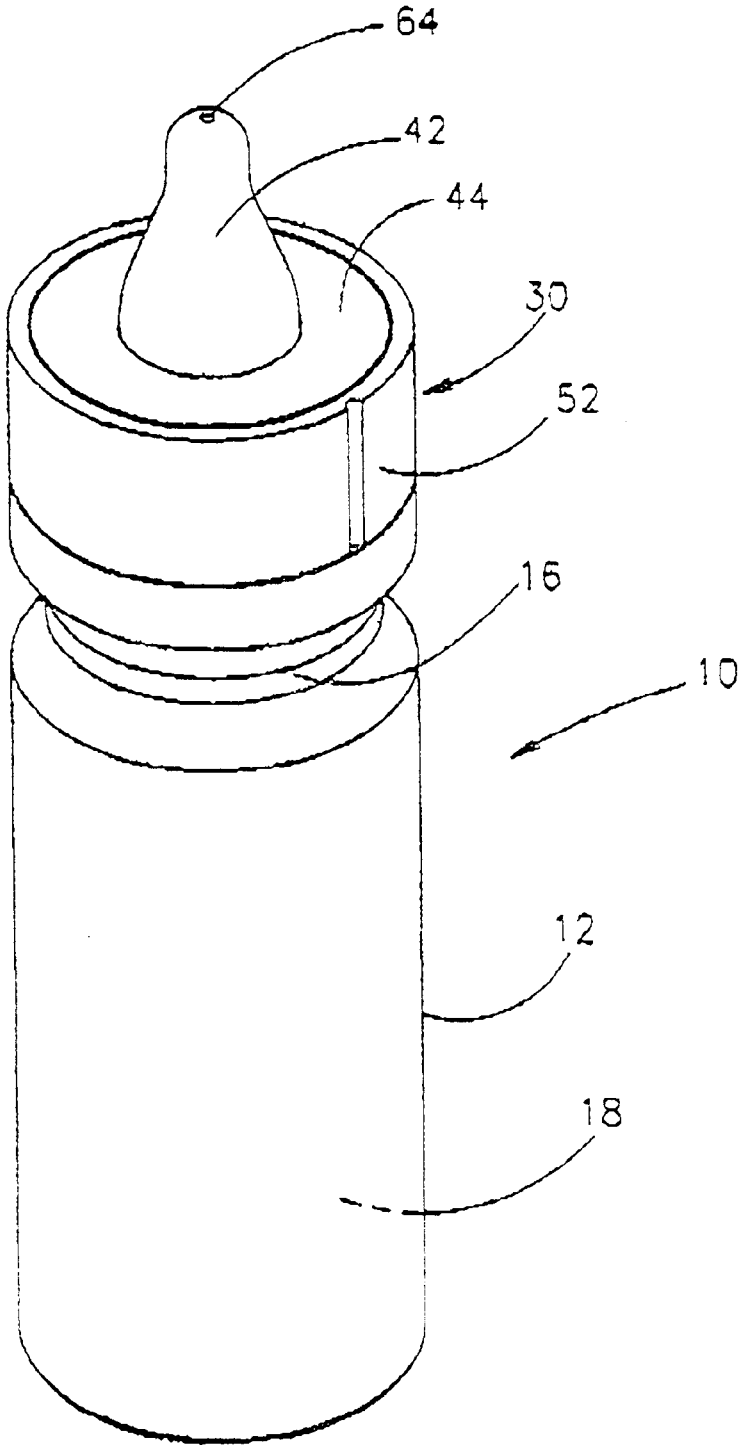
FIG. 2 is a perspective view of the baby's feeding bottle with the cover removed.
Figure 3:
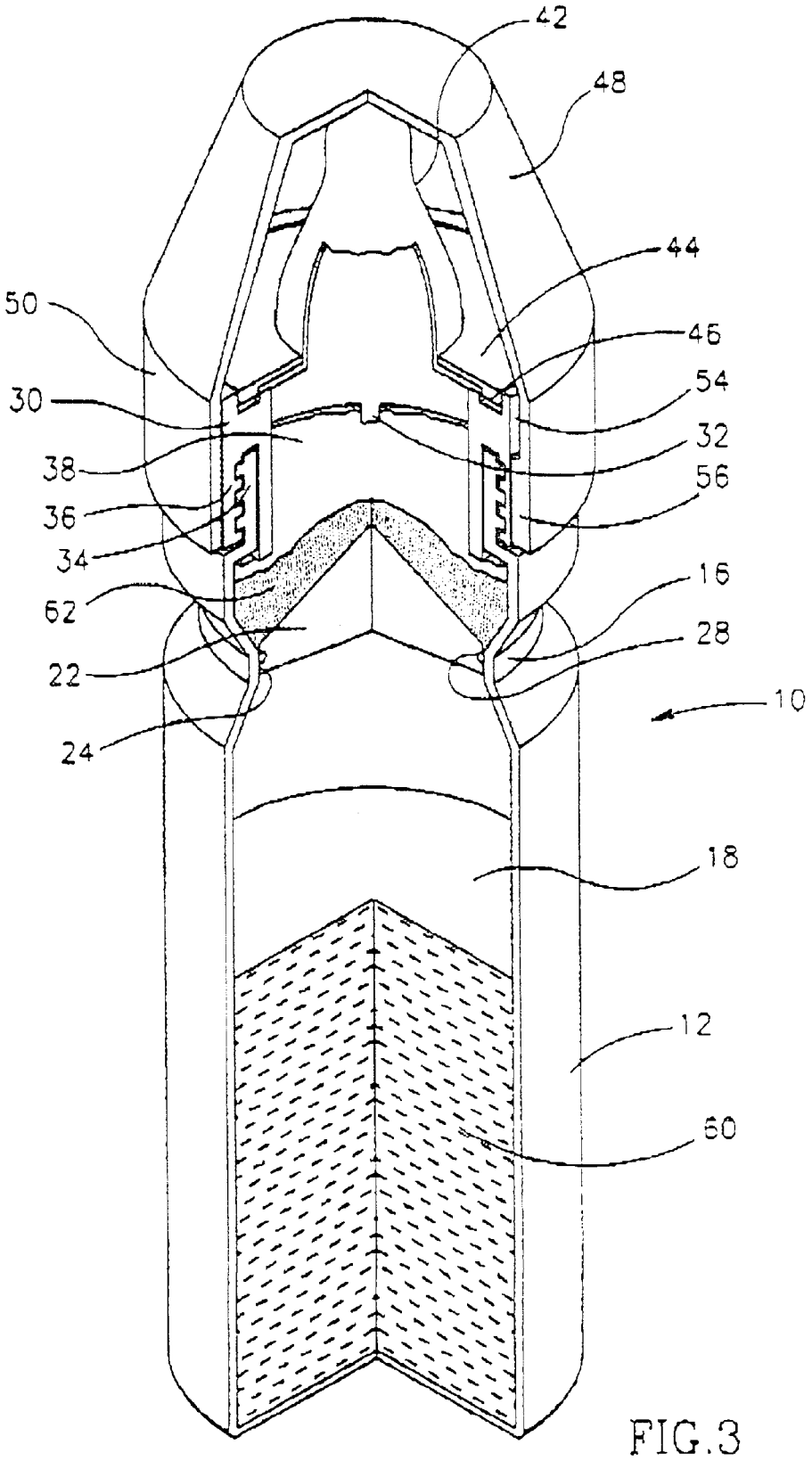
FIG. 3 is a perspective, partially cut-out view of the baby's feeding bottle in a storage position provided with a covering cap and holding two separately stored components of a liquid formulation.
Figure 4C:
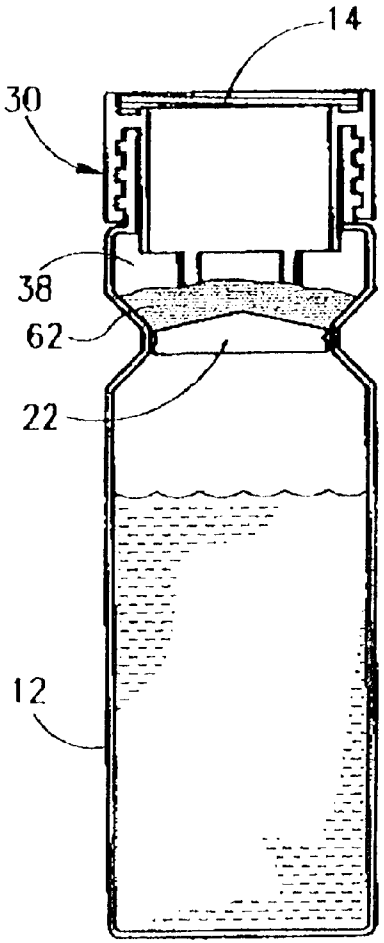
FIGS. 4A–4E show sequential steps in filling the baby's feeding bottle of the invention with two separately stored components, a liquid component and a powdered formula, which are to be mixed prior to use.
Figure 4B:
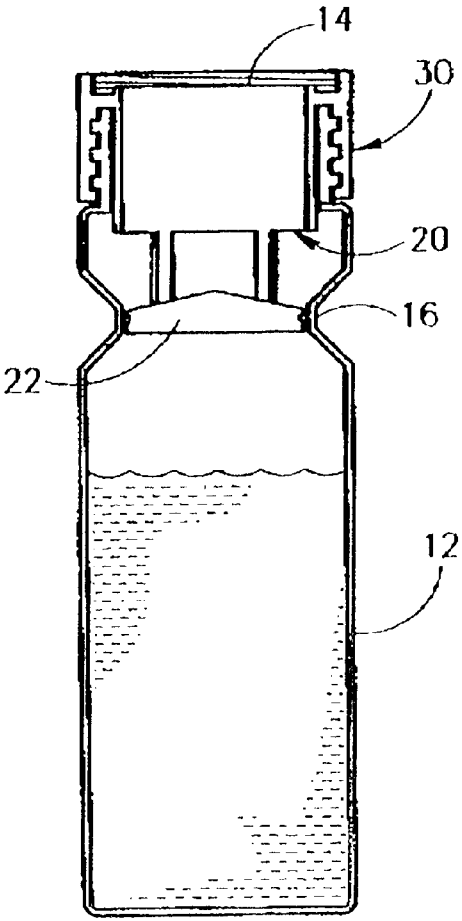
Figure 4A:
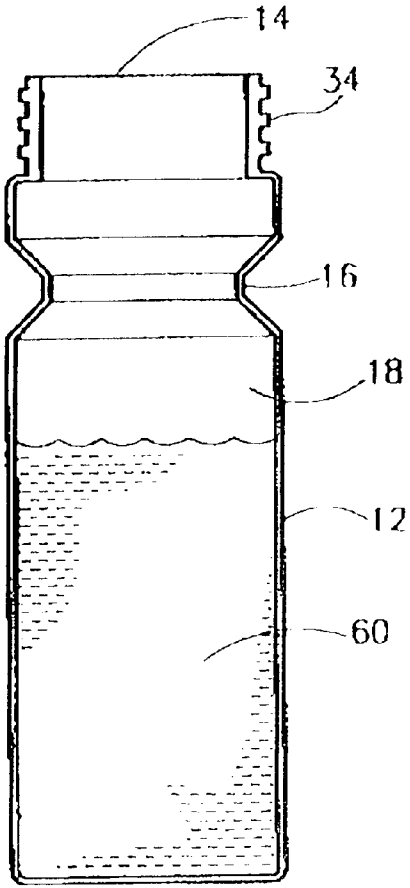
Figure 4E:
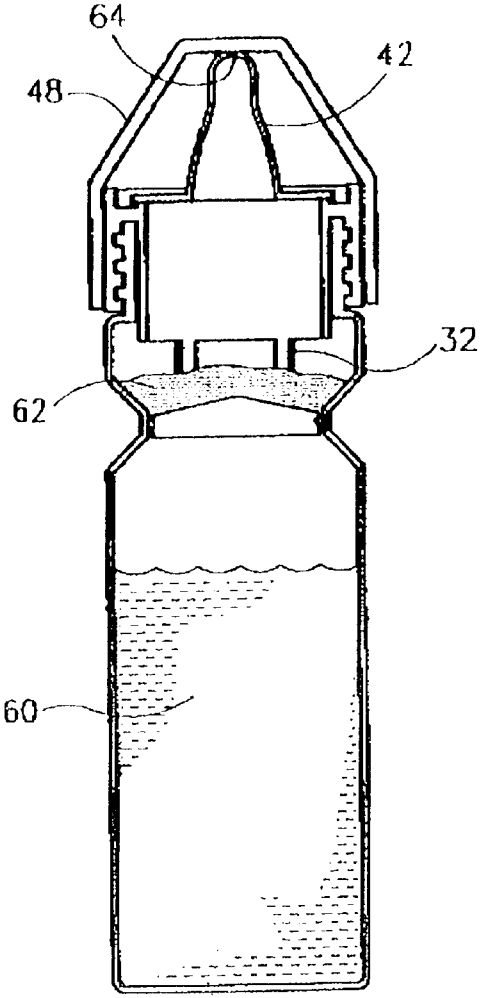
Figure 4D:
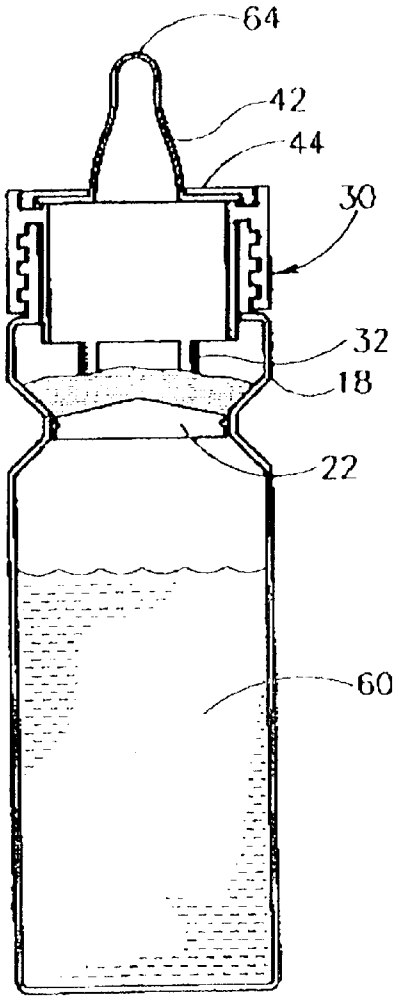

Reference is first being made to FIGS. 1–3 showing a baby's feeding bottle 10 in accordance with an embodiment of the invention. The baby's feeding bottle 10 has a general cylindrical housing 12 with an opening 14 and a constricted neck portion 16. The neck portion 16 defines a first compartment 18 beneath said neck portion. The container holds a displaceable member generally designated 20 which has a partition wall 22 with an edge 24 adapted for sealing engagement with internal walls of neck portions 16. The sealing engagement, in the specific embodiment, is ensured by means of a peripheral O-ring 28 fitted into an annular groove provided in edge 24. The partition wall 22 depends from a manipulable portion 30 by means of three downward projecting stems 32. Opening 14 is fitted with an external threading 34 for screw-engagement with internal threading 36 in displaceable member 20. In the specific shown herein, when the displaceable member is fully screwed onto opening 14, the partition wall comes to a sealing engagement with internal walls of neck portion 16, as can be seen particularly in FIG. 3. In this position of the partition wall, referred to above as "first state", the partition wall defines in fact two compartments, a first compartment 18 below said partition wall and a second compartment 38 between said partition wall and said opening. Upon rotation of the displaceable member in a counter-wise manner to that used for engagement, the partition wall is axially displaced towards the opening, disengaging the internal walls of neck portion 16, thus allowing communication between the two compartments.

The baby's feeding bottle has a nipple 42 which is fastened to a top end of the displaceable member 20 by means of a nipple retaining ring 44 which is snap fitted into a receptacle 46 at a top end of specimen member 20.

The baby's feeding bottle shown herein has further a cap 48 which has a cylindrical portion 50 which snugly engages the outer upper surface 52 of displaceable member 20. External face 52 has an axial groove 54 which cooperates with a radial inwardly facing projection 56 in cap 48. By virtue of this engagement, when cap 48 is rotated, this leads to rotation of displaceable member 20 and hence to axial displacement thereof.

In the specific embodiment shown, the first compartment 18 of the baby's feeding bottle holds a liquid 60, e.g. sterile water, and the second compartment 38 is filled with a powdered formula component 62.

The manner of production of a baby's feeding bottle of the kind shown in FIGS. 1–3, is shown stepwise in FIG. 4. As will be appreciated, the manufacture is preferably performed under a septic condition using sterile components, to ensure sterility. In the first step of manufacture, as shown in FIG. 4A, liquid 62, typically sterile water, is introduced into housing 12. As a next step, shown in FIG. 4B, the displaceable member 20 is screw-fitted onto the opening 14 of the housing whereby the partition wall 22 comes into a sealing engagement with internal walls of neck portion 16. At a next step, shown in FIG. 4C, powdered formula 62 is introduced into the second compartment 38, followed by sealing the opening with nipple 42, by means of retaining ring 44 (FIG. 4D) and then placing cap 48 over said nipple (FIG. 4E). In this position cap 48 seals opening 64 in the nipple 42.

When preparing a baby's feeding bottle in accordance with the invention, in a manufacturing plant, the use of good quality water may be ensured, which may be important in some regions with poor quality of running water.

Figure 5B:
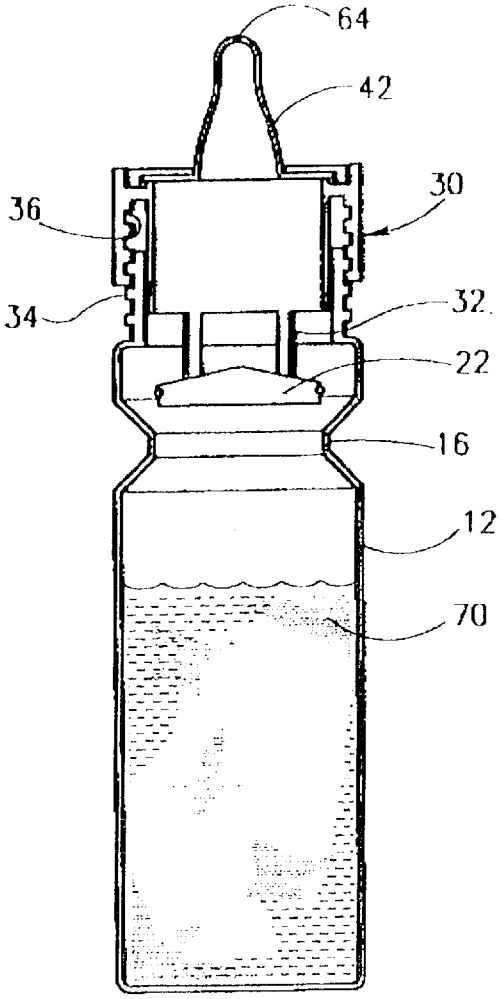
FIGS. 5A and 5B show steps in preparation of the baby's feeding bottle of FIG. 4 for feeding.
Figure 5A:
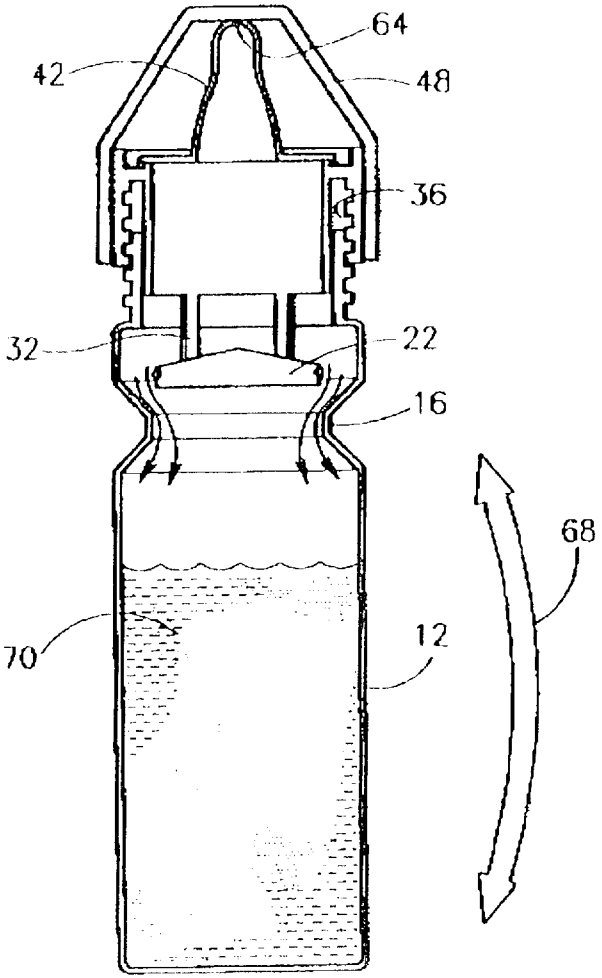

FIG. 5 shows the manner of preparation of the baby's feeding bottle for use. In a first step, (FIG. 5A) the displaceable member 12 is rotated whereby partition wall 22 is axially displaced whereby its edges disengage the inner walls of neck portion 16. In this position (said "second state"), the two compartments (the first and the second compartment) come into flow communication with one another. By agitating and rotation, represented by arrow 68, the dry formula 62 and liquid 18 are mixed with one another to yield liquid formula 70. By removal of cap 48, prior to use, the liquid formulation can be dispensed through opening 64 of nipple 42.

Figure 6C:
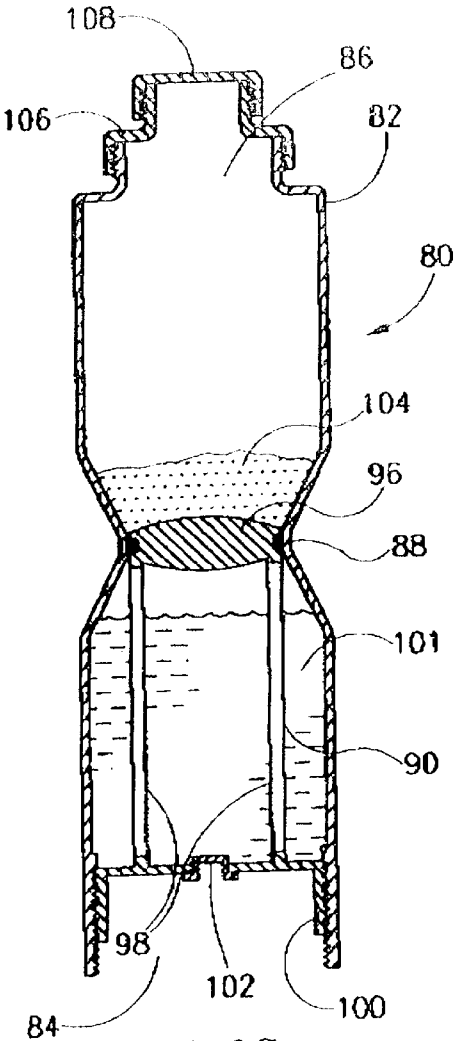
FIGS. 6A–6C show sequential steps in filling of a medicinal container in accordance with an embodiment of the invention.
Figure 6B:
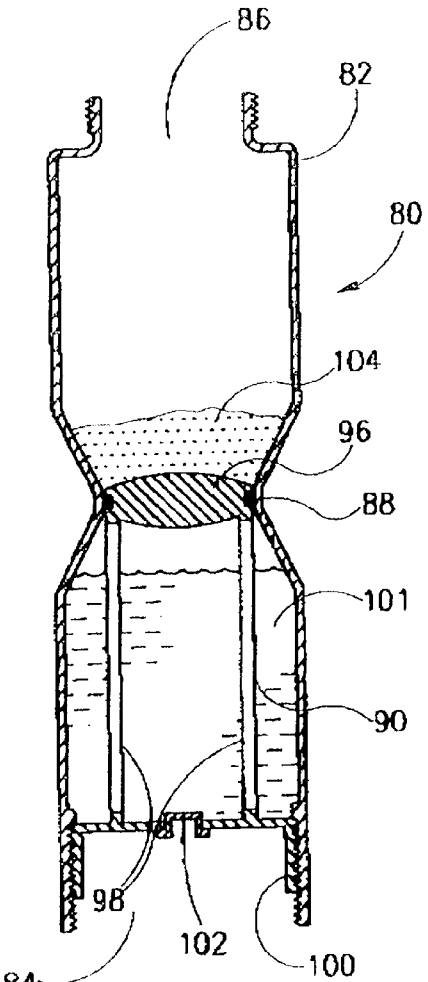
Figure 6A:
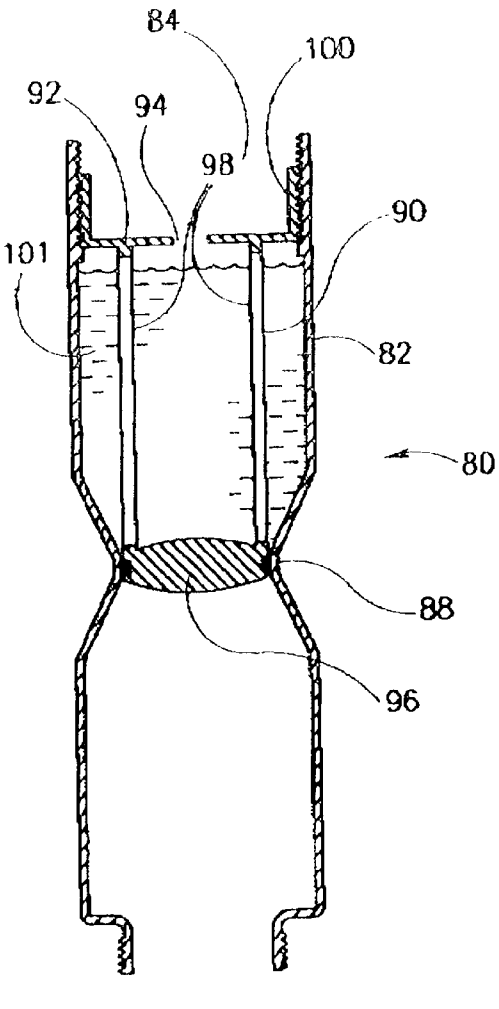

FIGS. 6A–6C show steps in filling of a two compartmental medicinal container 80 in accordance with an embodiment of the invention. Container 80 is formed from a generally tubular body 82 with an opening 84 at an end of the body constituting the bottom of the container, and a second opening 86, at an opposed, top end. Intermediate between the two ends is a neck portion 88.

Displaceable member 90 having an end wall 92 with a sealable filling aperture 94, and a partition wall 96 dependent from end wall 92 by stems 98 is fitted at end 84 by screw-threading at its peripheral portion 100. As a result of this screw-threading, rotation of the displaceable member 90 causes axial displacement of partition wall 96 with respect to neck portion 88.

After engagement of displaceable member 90 with body 82, a first component 101, e.g. water, is introduced through aperture 94, which is then sealed by stopper 102.

The container is then rotated into the position seen in FIG. 6B, with opening 86 facing upward. Then a second compartment 104, e.g. a powdered formulation, is introduced through opening 86 which is then sealed by closure assembly 106 with a resealable closure 108.

Figure 7B:
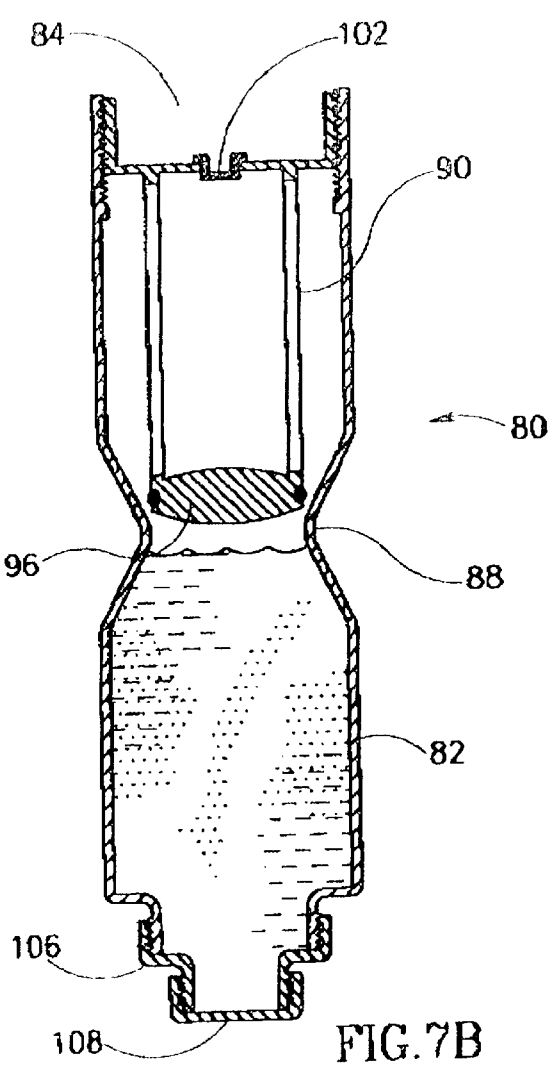
FIGS. 7A and 7B show steps in preparation of the formulation stored in the container of FIG. 6A, for dispensing.
Figure 7A:
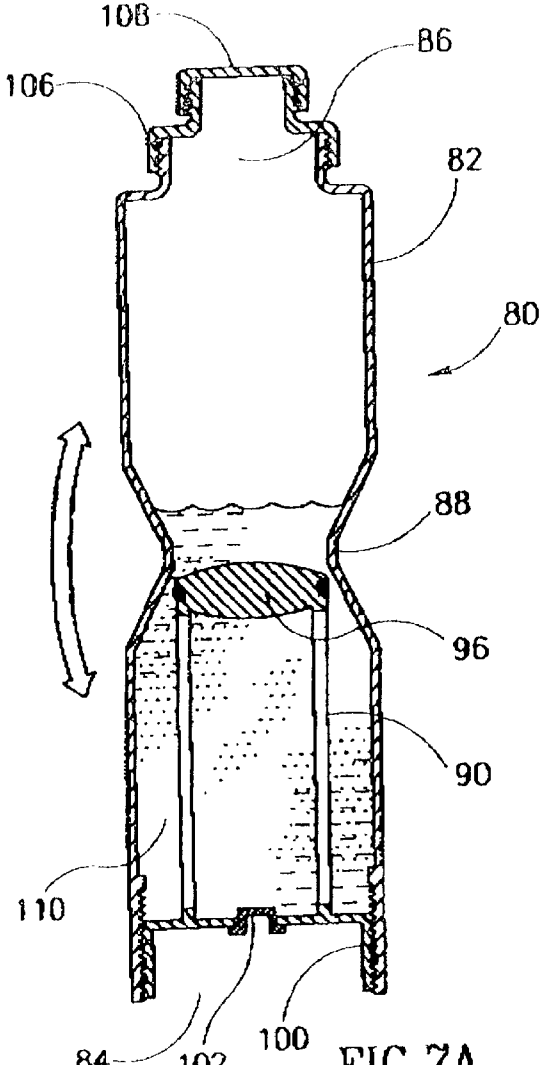

The manner of preparation of the container seen in FIGS. 6A–6C for use and dispensing of the relation is shown in FIGS. 7A and 7B. In a first stage, shown in FIG. 7A, the displaceable member 90 is rotated such that partition wall disengages neck portion 88 to allow mixing of components 101 and 104 to yield liquid formulation 110. After mixing and homogenization, the container may be rotated for dispensing through closure 108 as shown in FIG. 7B.

Another embodiment of container 120 is shown in FIGS. 8A–8F. Container 120 is similar to container 80, shown in FIGS. 6 and 7, and so is its manner of filling, with a difference residing in closure assembly 122 which allows dosing of the liquid formulation 124.

Figure 8B:
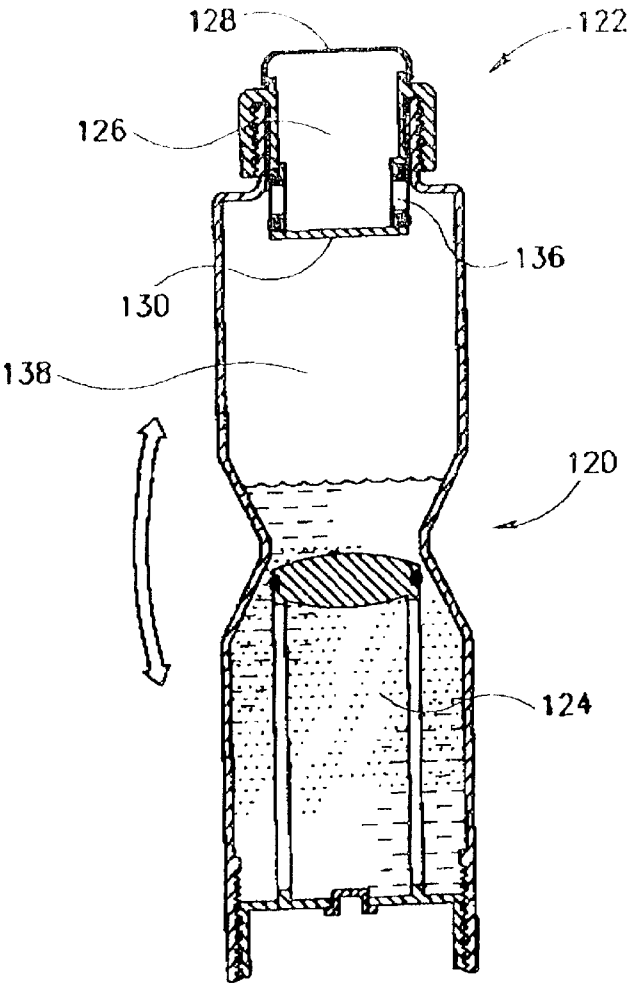
FIGS. 8A–8F show steps in preparation of an accumulation for dispensing in a medicinal container in accordance with another embodiment of the invention, comprising a formulation dosing arrangement.
Figure 8A:
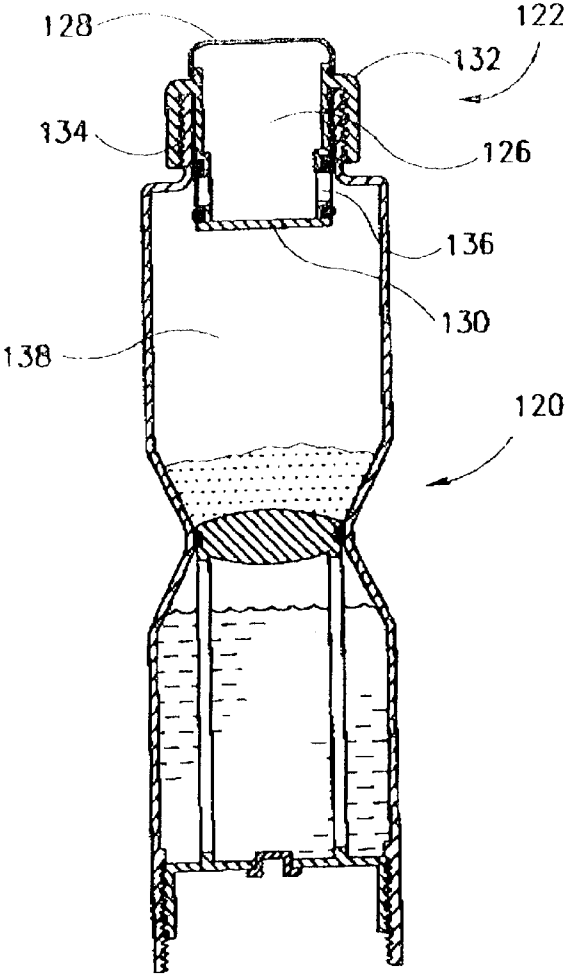
Figure 8D:
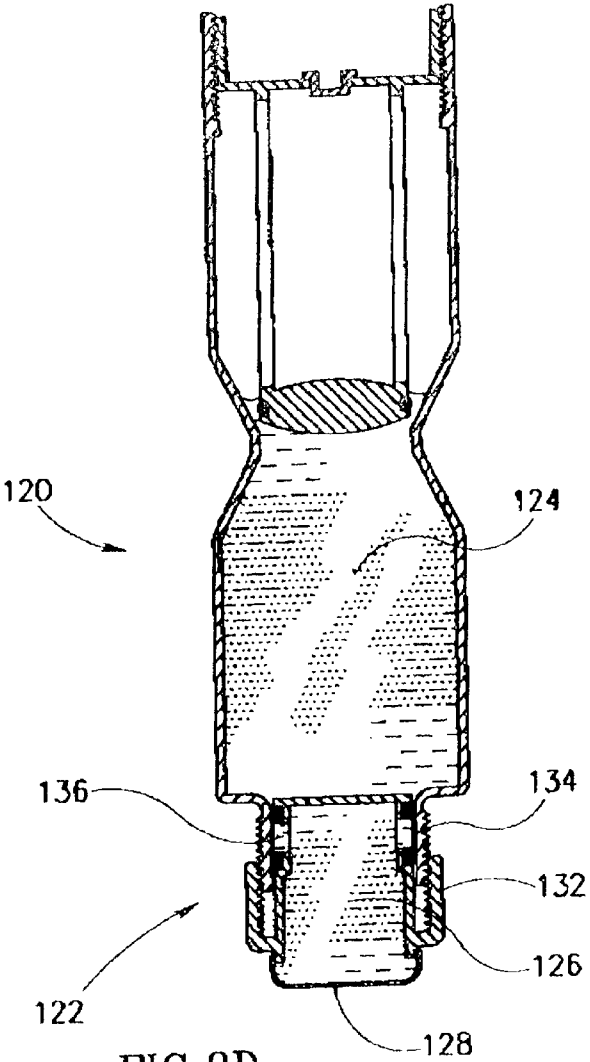
Figure 8C:
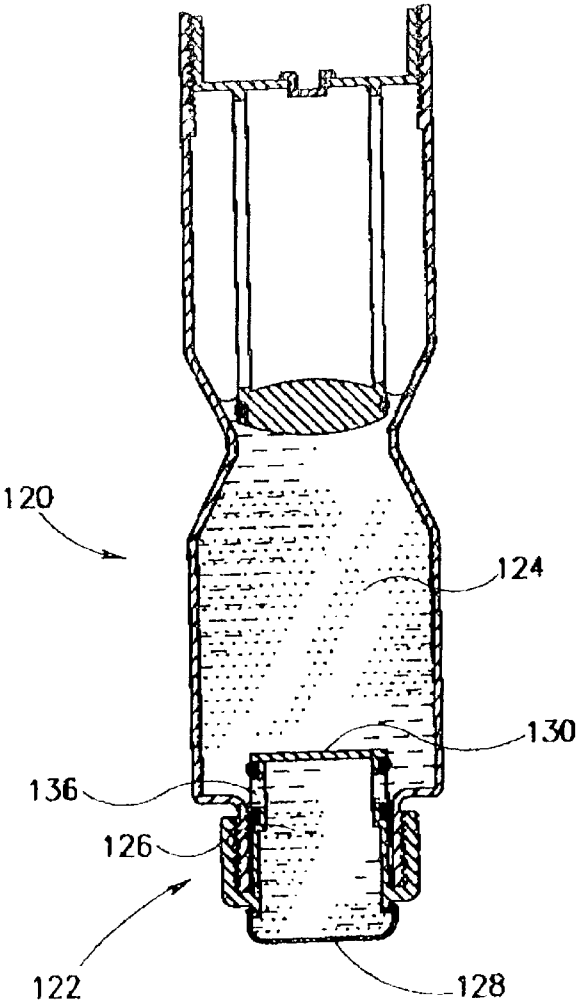

FIGS. 8A through 8F show different steps in preparation of the formulation and dispensing. Closure assembly 122 defines a compartment 126 formed between a lid 128 and a bottom wall 130 of the closure assembly 122. The closure assembly has a skirt 132 which screw engages with screw thread 134 at the opening of container 120. The closure assembly further has openings 136 which in the position shown in FIGS. 8A–8C, provide for communication between compartment 126 and interior space 138 of container 120.

Figure 8F:
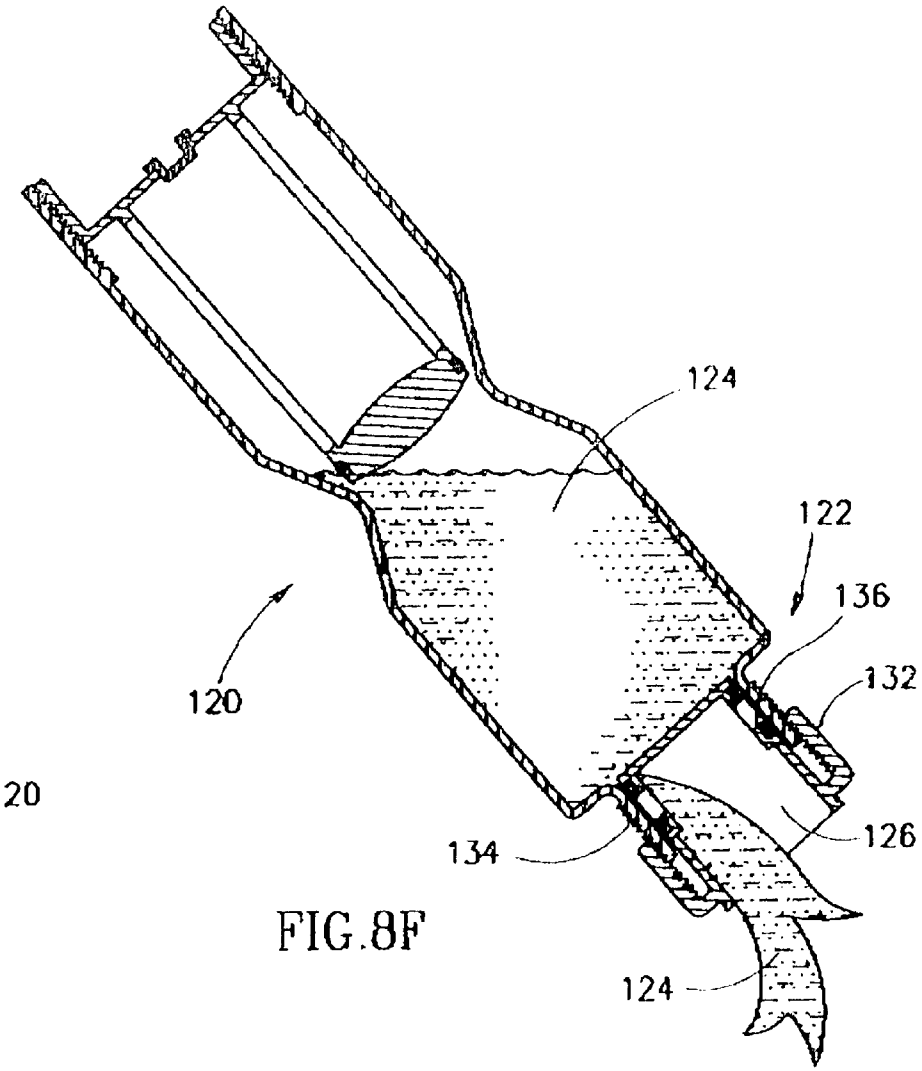
Figure 8E:
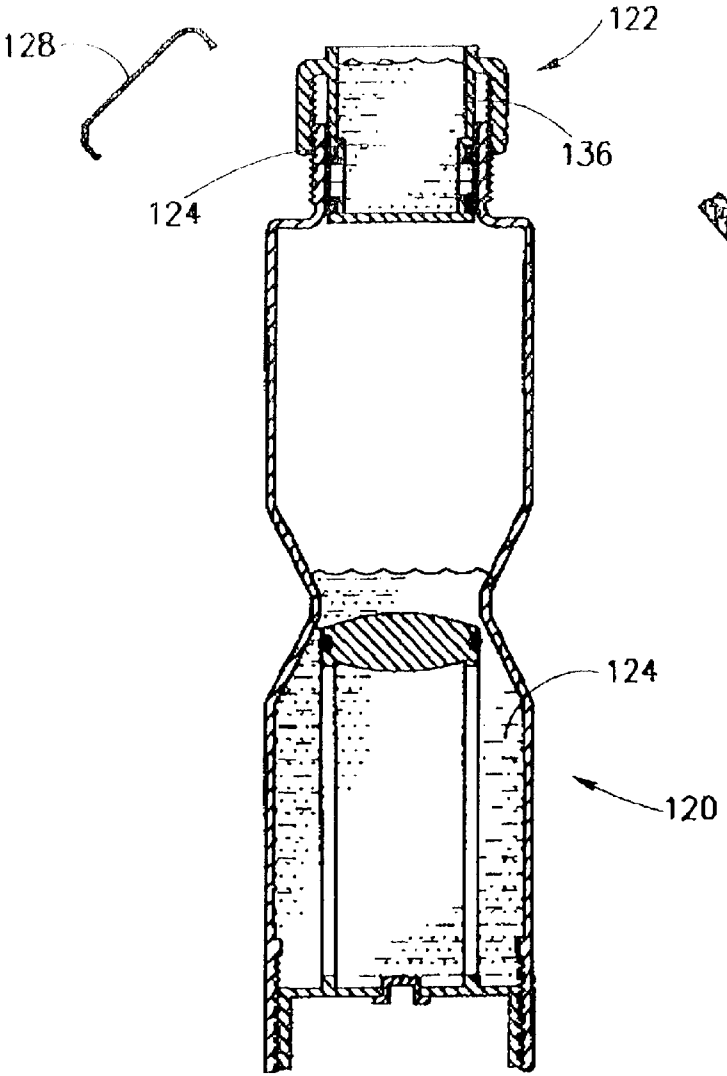
Figure 9C:
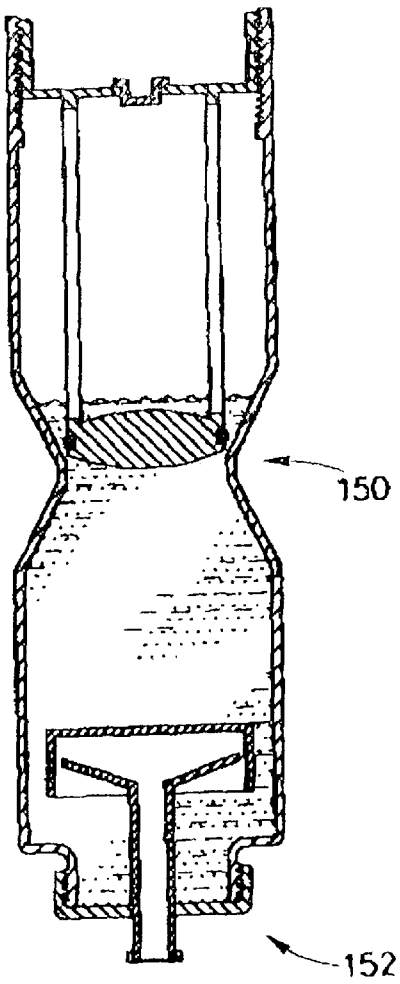
FIGS. 9A–9E show sequential steps in the preparation for dispensing of a medicinal formulation stored in a container in accordance with another embodiment of the invention, with a different dosing arrangement.
Figure 9B:
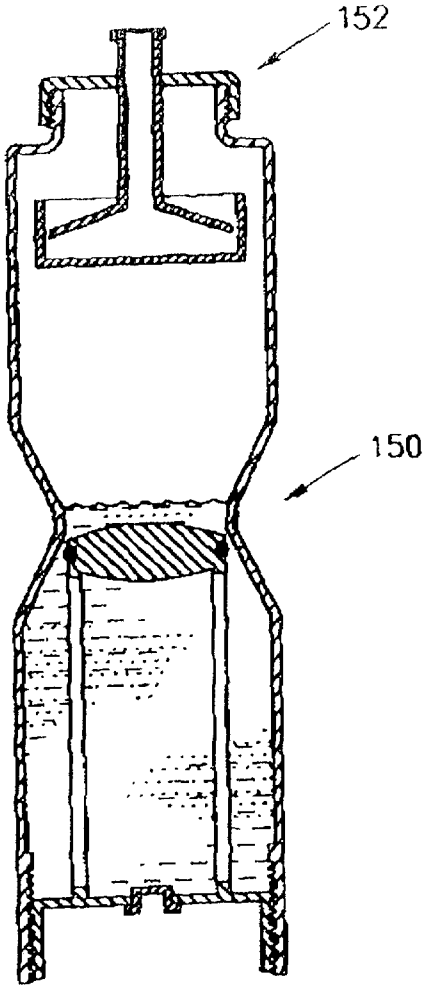
Figure 9A:
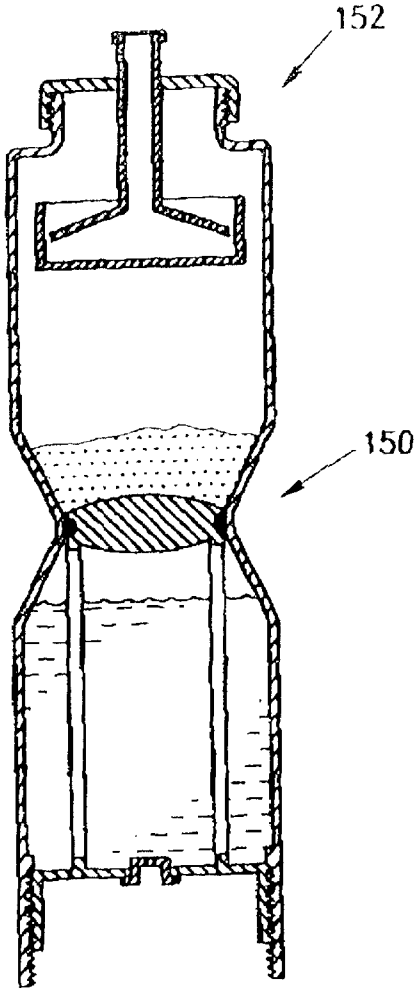
Figure 9E:
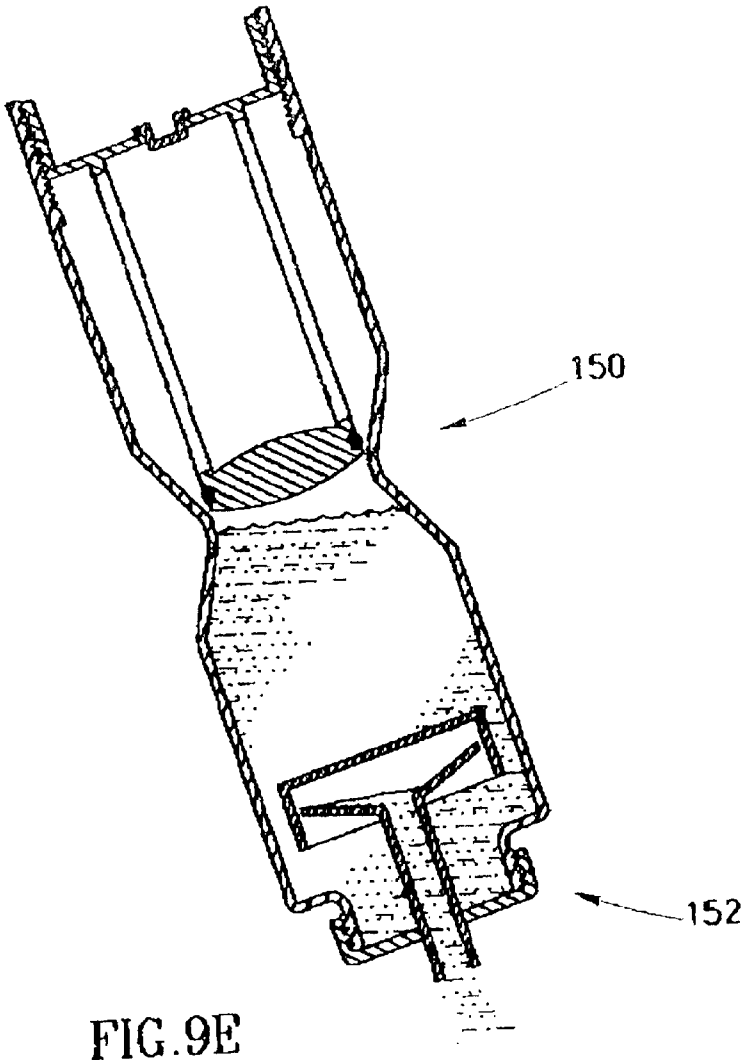
Figure 9D:
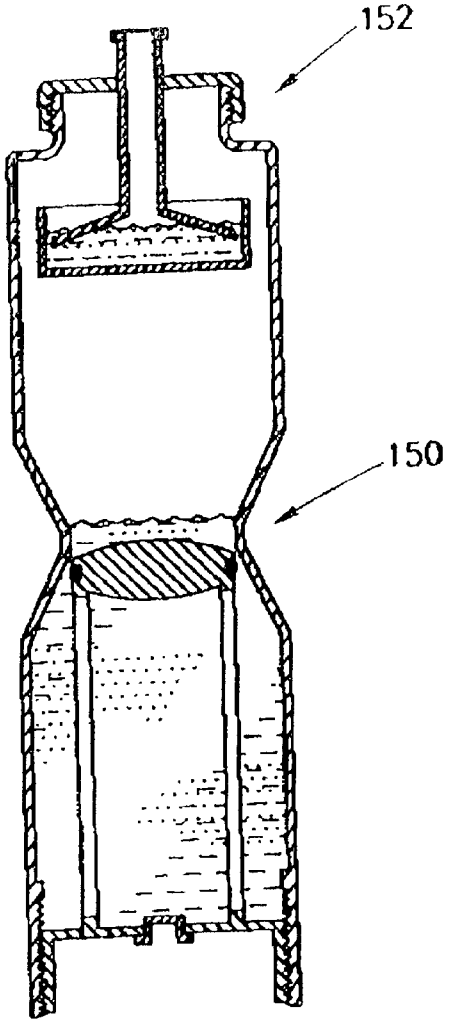

After mixing the two components, as shown in FIG. 8B, the container is rotated and consequently the liquid formulation fills compartment 126 through openings 136 (FIG. 8C). The closure assembly 122 is then rotated so that openings 136 are closed (FIG. 8D) and the container can be rotated (FIG. 8E). Then the lid 128 can be removed and the content of compartment 126 may be dispensed (FIG. 8F).

Another embodiment of a container 150 is shown in FIGS. 9A–9E. Here again, this container differs from containers 80 and 120 in the nature of the closure and dosing assembly 152. The manner of dosing using closure assembly 152 is self evident from FIGS. 9A–9E.

What is claimed is:

1. A container comprising:

a housing having a dispensing opening, a bottom end and a neck portion between said opening and said bottom end of the housing;

a displaceable member disposed within said housing and having a partition wall with an edge adapted for a sealing engagement with internal walls of said neck portion, thereby defining two compartments separated by said partition wall;

said displaceable member engaging the bottom end of the container and being axially displaceable between two positions along an axis extending through said neck portion, said two positions comprising a first position where the edge of said partition wall sealingly engages the internal walls of said neck portion, and a second position where said edge and said internal walls are disengaged permitting the flow communication between the two compartments.

2. A container according to claim 1, wherein said neck portion has a circular cross-section and said partition wall is circular.

3. A container according to claim 1, wherein said partition wall is dependent from a manipulable portion of said displaceable member by means of one or more stems.

4. A container according to claim 1, wherein the neck portion is formed as a constricted portion in an otherwise cylindrical container.

5. A container according to claim 1, wherein said component is a liquid and said second component is a powdered formulation.

6. A container according to claim 5, being a baby's feeding bottle.

7. A container according to claim 1, holding two components of a medicinal formulation.

8. A container according to claim 1, wherein said displaceable member has a wall portion sealably engaged at the bottom end and defining the bottom wall of the container.

9. A container according to claim 8, wherein said wall portion is provided with a sealable opening to allow filling of a component into a bottom compartment of the container.

10. A container according to claim 1, said displaceable member is displaced by axial pulling or pushing.

11. A method for the preparation of a liquid formulation from a priori two individual components, the method comprising:

(a) providing a container according to claim 1, with each of the two components being stored in one of the container's two compartments;

(b) axially displacing said displaceable member into said second compartment;

(c) agitating the container to mix the two components into said formulation.

12. A process for preparing a container holding two separate components of a formulation to mix with one another prior to use, the process comprising:

(a) providing a body for use as a housing of a container, having an internal space extending between two open ends and neck portion intermediate the two ends; one of the two ends, which is the bottom end of the container, being fitted with an axially displaceable member comprising a wall portion sealable engaged at the open end in a manner allowing axial displacement and comprising a partition wall dependent from said wall portion with an edge adapted for sealing engagement with the internal walls of the neck portion to define a first, bottom compartment and a second, top compartment, said displaceable member comprising a sealable filling aperture in said wall portion;

(b) introducing a first component of said formulation into said first compartment through said filling aperture, and sealing said aperture;

(c) introducing said second component into said second compartment through the other of the two open ends; and (d) sealing said other end of the two open ends.

13. A process according to claim 12 being performed under aseptic conditions.

* * * * *